United States Patent [19]

Jóźwicki et al.

[11] 4,319,448

[45] Mar. 16, 1982

[54] PROCESS AND APPARATUS FOR PRODUCING YARN

[75] Inventors: Ryszard Jóźwicki; Bogdan Kluska; Czesław Radom; Jan Pacholski, all of Łódź, Poland

[73] Assignee: Instytut Włokiennictwa, Łódź, Poland

[21] Appl. No.: 136,445

[22] Filed: Apr. 2, 1980

[30] Foreign Application Priority Data

Apr. 13, 1979 [PL] Poland ..... 214921
Sep. 1, 1979 [PL] Poland ..... 218093

[51] Int. Cl.[3] ..... D01H 1/13
[52] U.S. Cl. ..... 57/58.89
[58] Field of Search ..... 57/58.89, 333, 350, 57/332

[56] References Cited

U.S. PATENT DOCUMENTS

| | | | |
|---|---|---|---|
| 2,928,228 | 3/1960 | Gotzfried | 57/58.89 |
| 3,851,455 | 12/1974 | Jóźwicki et al. | 57/58.95 |
| 4,077,197 | 3/1978 | Bowden et al. | 57/58.89 |
| 4,174,605 | 11/1979 | Pallay | 57/58.89 |

FOREIGN PATENT DOCUMENTS

| | | | |
|---|---|---|---|
| 1146792 | 4/1961 | Fed. Rep. of Germany | 57/58.89 |
| 1217333 | 5/1960 | France | 57/58.89 |
| 825776 | 12/1959 | United Kingdom | 57/58.89 |
| 279383 | 2/1969 | U.S.S.R. | 57/58.89 |

*Primary Examiner*—Donald Watkins

[57] ABSTRACT

A process and apparatus for producing yarn by pneumatic means employing a stationary vortex, wherein yarn is first formed by means of a basic twisting movement from air revolving in a spinning chamber and then subjected outside of the spinning chamber to an additional twisting movement corresponding to that of the spinning chamber.

3 Claims, 8 Drawing Figures

A-A

PROCESS AND APPARATUS FOR PRODUCING YARN

This invention relates to a method of production of yarn by pneumatic means employing a stationary vortex, and a device for production of yarn from staple fibre in accordance with same.

A known process of spinning yarn while employing a stationary vortex consists in introduction of fibres into an unrevolving spinning chamber, in forming thereof a ring rotating stationarily, under the action of the stream air, about the axis of said chamber, and in forming the yarn and in giving it a twist by doffing the fibres from the rotating ring, and in finally leading the yarn out of the chamber. In this process the yarn receives the twist only from the rotating fibre ring. Said process is known from the Polish Patent Specification No. 66 492, the analogues whereof are the Patent Specifications of USSR Nos. 506 306 and 489 351, of CSSR No. 184 760, of U.S. Pat. No. 3,851,455, of Switzerland No. 535 846, of France No. 2.153.179, of Great Britain No. 1,364,077, and of ERG No. 2.145.943.

A known device for production of yarn by pneumatic means employing a stationary vortex comprises an unrevolving spinning chamber being from one side closed with a partition provided with the yarn leading-out channel, and from the other side being connected to a vacuum source, and on its periphery being provided with tangential baffles supplying the air into the chamber, and with a channel for supplying the fibres. This machine is known from the Polish Patent Specification No. 66 462.

Another known process of production using a pneumatic method employing a stationary vortex consists in imparting to the forming yarn length, by means of the stationary vortex, a rotational speed higher than that shown by said length under the action of only the rotating stream of air. Hence, the yarn receives a higher number of twists than that being imparted by the stationary vortex itself.

Another known device for production of yarn by pneumatic means employing a stationary vortex and with increased rotational speed of the yarn end has the form of an unrevolving spinning chamber being from one side closed with a partition provided with a yarn lead-out channel, and from the other side being connected with a vacuum source, and being provided with a rotating hollow tube terminated from inside the spinning chamber, near to the centre of the vortex, with a protrusion or a friction surface for catching the yarn in order to set it into additional rotary motion beyond the vortex.

This second process and device for realization of said process are known from U.S. Pat. No. 4,077,197.

In process according to the present invention the yarn produced in the basic twisting moment originated by the air whirled in the spinning chamber is submitted to the action of additional twisting moment outside the spinning chamber, whereby the sense of action of the additional twisting moment is conformable with that of the basic twisting moment in the spinning chamber.

Owing to that a yarn is obtained with better lay-out of fibres, with higher strength, and with lower downiness than that produced in hitherto known spinning processes.

The process according to the invention will be now described in particular by means of an exemplary embodiment with reference to the accompanying drawing wherein FIG. 1 is a schematical illustration of the process of production of yarn under the action of both twisting moments.

The process of production of yarn according to the invention proceeds as follows: Fibres 1 doffed from the fibre ring 2 rotating under the action of the air stream are in the axis of said ring joined into a yarn 18 the twist whereof is effected by the twisting moment originating from the rotation of the fibre ring 2. The yarn 18 produced in this way is subjected to the action of an additional twisting moment applied to the yarn outside the spinning chamber at a small distance from the near end of the formed yarn. The sense of rotation of the additional twisting moment is conformable to that of the fibre ring 2.

In result of the action of additional twisting moment onto the yarn 18, the primary twist of yarn, originated in the fibre ring 2 rotating under the action of the air stream, gets cancelled partially or completely, and replaced with the twist effected by the additional moment. In result of said change of twists it follows a partial or complete cancellation of the twist 3 on the length of yarn 18 from the point of application of the additional twisting moment to the near point 4 of the formed yarn. That affords a better straightening of fibres and a more ordered arrangement of them in the yarn.

The essence of the device for production of yarn according to this invention employing the stationary vortex and additional twisting moment comprises the provision of a rotational quasi-twist sleeve of known design for transmitting the torque onto the yarn. The quasi-twist sleeve is mounted outside of the spinning chamber in the way of leading-out the yarn between the inside of the spinning chamber and the take-up rollers, preferably inside a partition separating the spinning chamber therefrom. The sense of rotation of the quasi-twist sleeve is conformable to the sense of rotation of the fibre ring in the chamber.

Another device is provided with an additional unrevolving chamber with tangential air channels at the periphery, disposed outside the spinning chamber, preferably in the partition closing the spinning chamber. Said additional chamber is provided with a connection with a vacuum or an overpressrue source.

The device according to the invention will be now explained with more particulars by means of an exemplary embodiment with reference to the accompanying drawing wherein.

Figure 6:
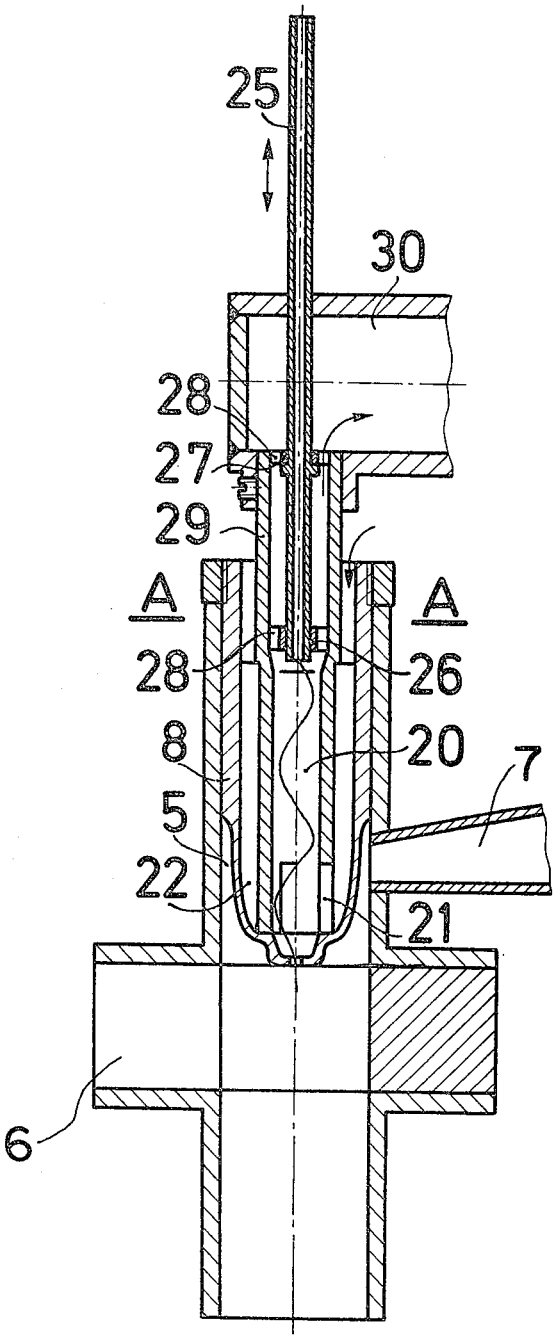
FIG. 6 shows another device provided with an additional unrevolving spinning chamber supplied with air through vacuum feed.
Figure 7:
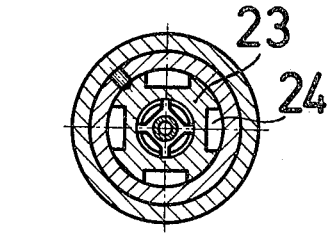
FIG. 7 is a cross-sectional view of the device as shown in FIG. 6.
Figure 8:
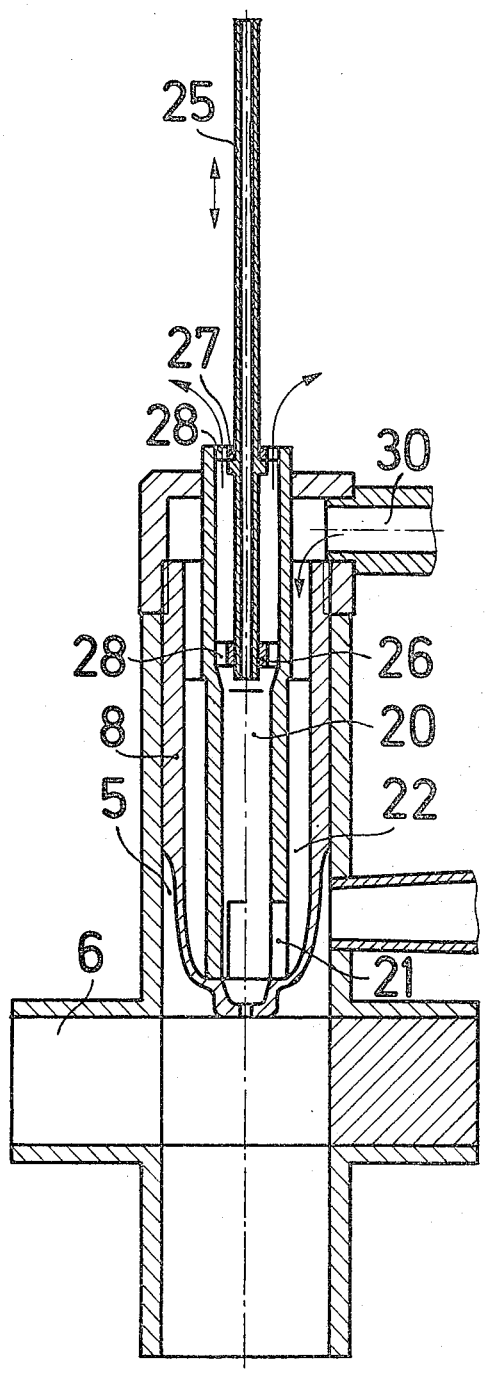

and FIG. 8 the same device as shown in FIG. 6 but supplied with air under pressure.

Figure 1:
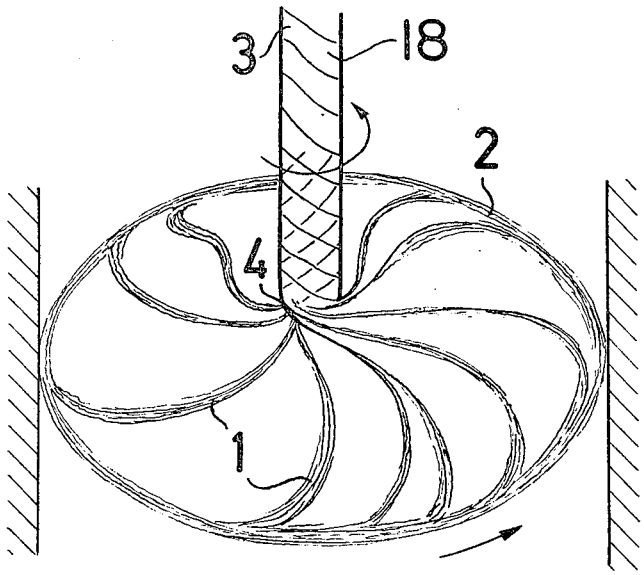
Figure 2:
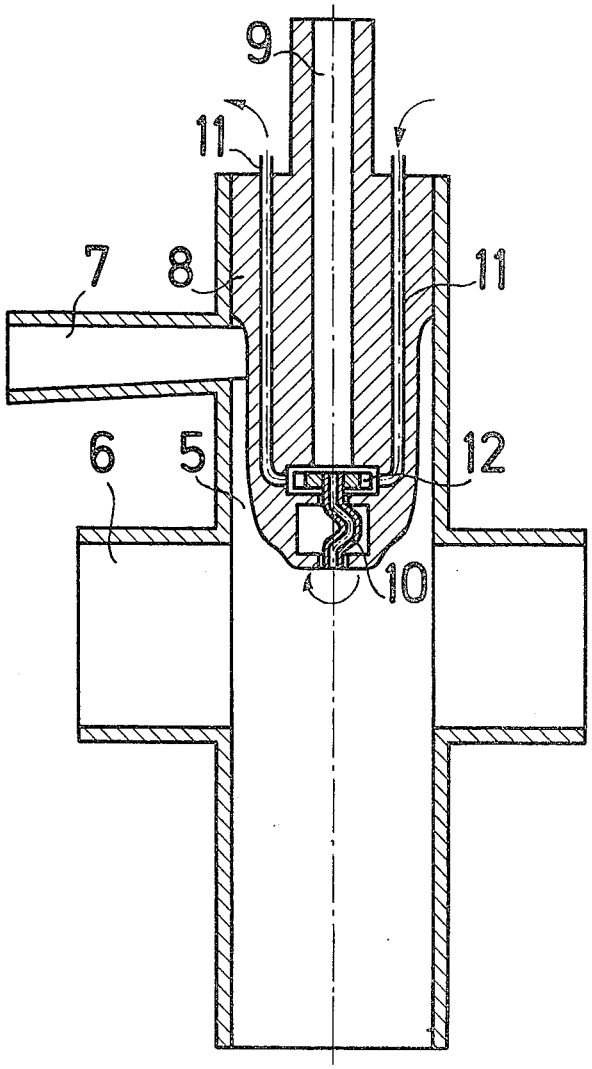
FIG. 2 shows a device with power drive of the quasi-twist tube.

The device for production of yarn, according to the invention, illustrated in FIG. 2 comprises of an unrevolving spinning chamber 5 with air supply channels 6 and the channel 7 supplying the fibres 2 on the periphery. The chamber 5 is from one side connected with a vacuum source not shown in the drawing, and from the other side it is closed with the partition 8. In the partition 8 there is provided a coaxial channel 9 for leading out the ready yarn from the spinning chamber. In the channel 9 of the partition 8 the quasi-twist sleeve 10 is disposed wherethrough from the chamber 5 lead out yarn passes. The quasi-twist sleeve 10 performs a forced rotational motion with a sense conformable to that of rotating of fibres in the spinning chamber. The quasi-twist sleeve 10 is arranged in the form of a bend, and its rotary motion is acutated by means of air streaming through the conduit system 11 and acting onto the turbine 12.

Figure 3:
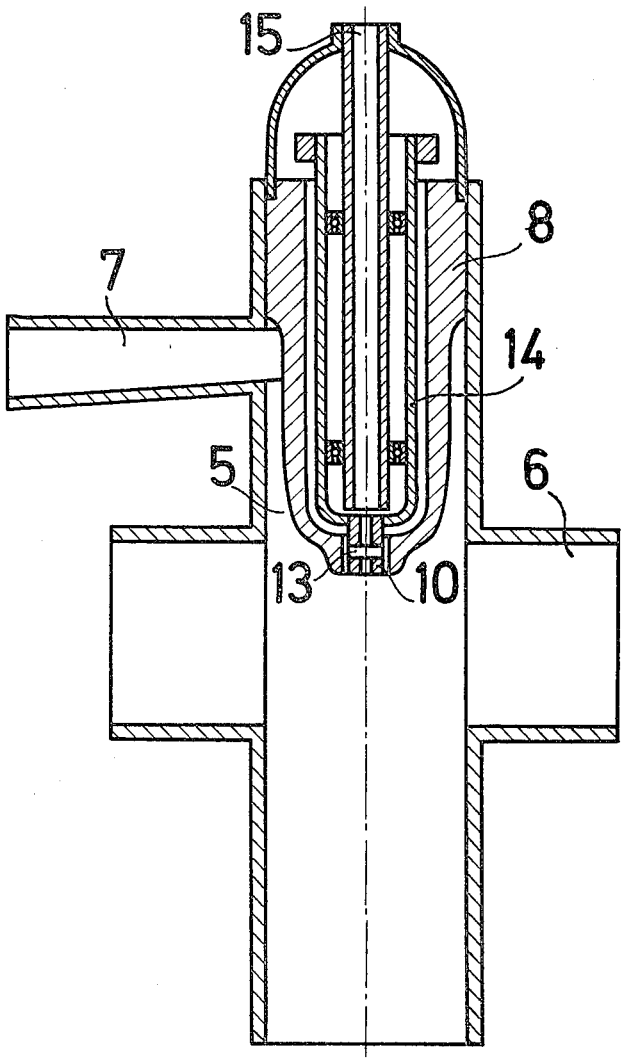
FIG. 3 shows a device with pneumatic drive of the quasi-twist tube.

In the device shown in FIG. 3 the quasi-twist sleeve 10 is provided with a pin 13 constituting a beam for clamping of the yarn being led out. The rotary motion of the quasi-twist sleeve 10 is actuated mechanically and is transmitted from the point of application through the transmission tube 14 to the quasi-twist tube. Inside the transmission tube 14 an unrevolving tube 15 is disposed constituting the yarn leading-out channel.

The device operates in the following way:- the yarn being led out of the chamber 5 passes through the quasi-twist sleeve 10 wherein it gets clamped which causes its simultaneous displacement. Due to said clamping, the torque of the quasi-twist sleeve 10 is transmitted onto the yarn. The action of said torque causes a partial or complete cancellation of the twist on the yarn length between the inside of the chamber 5 and the place of transmission of the torque from the sleeve 10 onto the yarn, whereas beyond the quasi-twist sleeve 10 the yarn twist returns to its primary value. The temporary reduction of the twist of yarn being pulled through the point of clamping in the quasi-twist sleeve, and the repeated twisting thereof cause a straightening of fibres, increasing the strength and reducing the downiness of the yarn.

Figure 4:
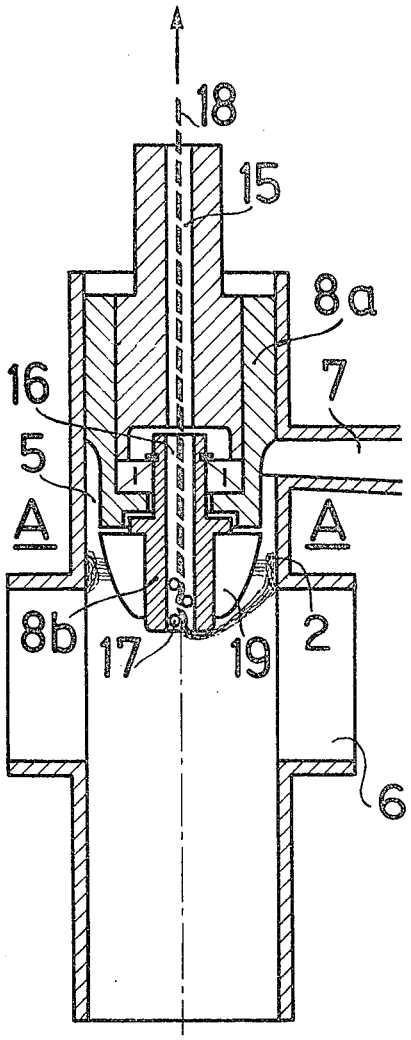
FIG. 4 shows a device wherein the quasi-twist tube has a side surface from the side of the spinning chamber shaped in the form of vanes.
Figure 5:
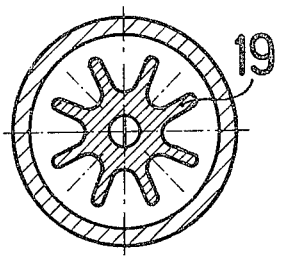
FIG. 5 shows a device in the cross-sectional view A—A after FIG. 4.

The device according to the invention, shown in FIG. 4, comprises an unrevolving chamber 5 provided on its periphery with a channel 2 for supplying the raw material, and with a channel 6 to supply air into the chamber. The chamber 5 is from one side connected with a vacuum source, not shown in the drawing, and from the other side it is closed with a partition composed of the unrevolving part 8*a* and the revolving part 8*b*. The revolving part 8*b* of the partition is borne in the unrevolving part 8*a* and has in its axis the coaxial channel 16 for leading the yarn out, disposed coaxially with the channel 15 in the unrevolving part 4 of the partition. The yarn leading-out channel 16 has the form of a quasi-twist sleeve with clamps 17 for transmitting the rotary motion of the part 8*b* onto the yarn 18. The revolving part 8*b* of the partition has on the side from the inside of the chamber 5 vanes 19, whereupon the air stream acts, rotating in the spinning chamber 5, causing thus the rotary motion of the part 8*b*. From the rotating part 8*b* the torque is transmitted onto the yarn 18 being led out through the channel 16 having the form of a quasi-twist sleeve, imparting to it an additional twist.

Another device, shown in FIG. 6, comprises an unrevolving spinning chamber 5 with baffles 6 for to supply air thereinto, and with a channel 7 to supply fibres disposed on the periphery. The spinning chamber is from one side connected with a vacuum source, not shown in the drawing, and from the other side it is closed with the partition 8. In the partition 8 an additional unrevolving chamber 20 is arranged. The chamber 20 is provided with air baffles 21 disposed on the periphery, perferably from the side of the yarn inlet to this chamber 20. The baffles 21 are disposed tangentially to the inside wall of the chamber 20, and have the direction conformable to that of the baffles 6 of the spinning chamber 5. Between the outer wall of the additional chamber 20 and the wall of the partition 8 the channel 22 is formed, wherethrough air is led to the baffles 21. A shoulder 23 fastening the additional chamber 20 in the partition 8 is provided with a recess 24 for supplying air to the channel 22. In the chamber 20 is coaxially and slidably fitted a tube 25 for leading out the produced yarn. In brackets 26 and 27 supporting the tube 25 channels 28 are provided to discharge the air flowing through the chamber 20. The additional chamber 20 is with its end 29 connected with the vacuum source not shown in the drawing.

The device of FIG. 8 operating at overpressure has channel 22 connected with the conduit 30 to a compressed air source not shown in the drawing, whereas the end of the additional chamber 20 is provided with outlets 28 to exhaust air pumped into said chamber.

The device presented in FIGS. 6 and 8 operates as follows:

The air sucked out through the conduit 30 (FIG. 6) from the additional chamber 20, or pumped through the conduit 22 (FIG. 8) into the baffles 21, flows through the channel 22 owing to the arrangement of baffles 21, wherefrom it comes into the chamber 20 wherein it starts to whirl on the inner walls of said chamber. Under the action of the whirled air stream the yarn formed in the spinning chamber 5 and passing through the chamber 20 through the tube 25 whirls about the axis of the additional chamber 20 and simultaneously travels along a helical path over the inner walls of the chamber 20. In result of whirling it follows the turning of the yarn about its axis, which additionally contributes to forming the yarn in the spinning chamber, and the helical motion of the yarn on the walls of the additional chamber 20 causes a thickening of fibres within the yarn. To initiate the spinning the channel 25 comes closer to the opening in the partition 8. On commencing the spinning the channel 25 with the additional chamber 20 is withdrawn from the primary position.

What is claimed is:

1. A spinning device for forming a yarn comprising a spinning chamber provided with tangential airducts for operation on the axially stationary air vortex principle, and a rotatably mounted false-twisting means separated from the spinning chamber on the yarn withdrawal side thereof and adapted to receive yarn from the spinning chamber, the false-twisting means being shaped so as to enable transmission of torque to yarn withdrawn from the spinning chamber in a direction identical to the direction at which the air ducts are tangent to the spinning chamber, said false-twisting means is provided with vanes in communication with air entering the spinning chamber, the vanes being so shaped and arranged that upon rotation thereof by the air current entering the spinning chamber the false-twisting means is rotated.

2. A spinning device as claimed in claim 1, in which a partition is provided closing the yarn outlet side of the spinning chamber, said partition forming a second chamber separated from the spinning chamber, said second chamber having inlet air ducts arranged tangently to the other periphery thereof and in the same direction as the inlet air ducts of the spinning chamber.

3. A spinning device as claimed in claim 2, wherein between an external wall of the second chamber and an internal wall of the partition duct means are provided communicating with the interior of the second chamber and with the atmosphere, said duct means being formed by recesses provided in mounting means for the second chamber, one end of said second chamber protruding from said partition and being connected to an air duct through holes bored in annular supports which retain a yarn lead-out tube in the end part of said second chamber.

* * * * *